US006079382A

United States Patent [19]

Schafer et al.

[11] Patent Number: 6,079,382

[45] Date of Patent: Jun. 27, 2000

[54] LOCKING DEVICE FOR A DEVICE FOR VARYING VALVE TIMING OF GAS EXCHANGE VALVES OF AN INTERNAL COMBUSTION ENGINE

[75] Inventors: Jens Schafer, Herzogenaurach; Joachim Dietz, Frensdorf; Andreas Strauss, Herzogenaurach, all of Germany

[73] Assignee: INA Walzlager Schaeffler oHG, Germany

[21] Appl. No.: 09/210,251

[22] Filed: Dec. 11, 1998

[30] Foreign Application Priority Data

Dec. 13, 1997 [DE] Germany ..... 197 55 495

[51] Int. Cl.[7] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,775,279 | 7/1998 | Ogawa et al. | 123/90.17 |
| 5,870,983 | 2/1999 | Sato et al. | 123/90.17 |

FOREIGN PATENT DOCUMENTS

| | | |
|---|---|---|
| 3937644 | 5/1991 | Germany . |
| 19541770 | 6/1997 | Germany . |
| 19606724 | 8/1997 | Germany . |

*Primary Examiner*—Weilun Lo

*Attorney, Agent, or Firm*—Bierman, Muserlian and Lucas

[57] ABSTRACT

A locking device for a device (1) for varying the valve timing of gas exchange valves of an internal combustion engine, said device (1) comprising an element (3) which is attached to a crankshaft of the internal combustion engine and is in driving relationship with the crankshaft through a traction element, said device further comprising an element (4) attached rotationally fast to the camshaft (2), there being arranged between the two said elements (3, 4), at least two pressure chambers (5, 6) connected to a pressure medium supply and a hydraulically actuatable adjusting element (7) through which a connection for transmitting force from the element (3) attached to the crankshaft to the element (4) attached to the camshaft is established, and through which the two said elements (3, 4) can be made to rotate or be fixed relative to each other within an adjusting range. According to the invention, the element (4) attached to the camshaft (2) is arranged so as to penetrate axially through the element (3) attached to the crankshaft and comprises a free end (8) outside of the device (1), on which free end (8) is arranged a sealed locking element which is connected hydraulically to one or more of the pressure chambers (5, 6) of the device (1) while being axially displaceable on an axial guide (9), and with which locking element, when the pressure of the hydraulic medium falls below a pressure required for displacing the adjusting element (7) of the device, a non-rotatable force transmission connection between the element (3) attached to the crankshaft and the element (4) attached to the camshaft (2) in one or more angular positions thereof relative to each other can be established independently of the adjusting element (7) with the help of an auxiliary energy.

11 Claims, 1 Drawing Sheet

LOCKING DEVICE FOR A DEVICE FOR VARYING VALVE TIMING OF GAS EXCHANGE VALVES OF AN INTERNAL COMBUSTION ENGINE

FIELD OF THE INVENTION

A locking device for a device for varying the valve timing of gas exchange valves of an internal combustion engine, said device being arranged in the region of the cylinder head of the internal combustion engine on an inlet or an outlet camshaft and comprising an element which is attached to a crankshaft of the internal combustion engine and is in driving relationship with the crankshaft through a traction element, said device further comprising an element attached rotationally fast to the camshaft, there being arranged between the two said elements, at least two pressure chambers connected to a pressure medium supply and a hydraulically actuatable adjusting element through which a connection for transmitting force from the element attached to the crankshaft to the element attached to the camshaft is established, and through which the two said elements can be made to rotate or be fixed relative to each other within an adjusting range and thus effect a relative rotation and/or a continuous hydraulic clamping of the camshaft relative to the crankshaft.

BACKGROUND OF THE INVENTION

Variously configured devices of the pre-cited type are known in the technical field and depending on their principle of operation, they can be divided into so-called axial piston adjusting devices and so-called vane-type adjusting devices. In the case of axial piston adjusting devices, the hydraulically actuated adjusting element is constituted by an axially displaceable adjusting piston which cooperates with helical gears on the element attached to the crankshaft and on the element attached to the camshaft, while in vane-type adjusting devices, the hydraulically actuated element is constituted by a number of radial vanes on the element attached to the camshaft which are displaceable within pressure chambers in the element attached to the crankshaft.

On starting of an internal combustion engine configured with such a vane-type or axial piston adjusting device, the problem arises that the respective adjusting element moves at a high speed into a position of maximum displacement in which its repeated abutting is accompanied by a considerable amount of noise. This is due to the fact that when the engine has been turned off, the hydraulic medium contained in the device gradually escapes therefrom so that the adjusting element is no longer sufficiently supported hydraulically. Due to the torsional vibrations of the camshaft, the adjusting element, because of a lack of hydraulic support, is displaced into an end position on re-starting of the internal combustion engine, with the already mentioned considerable noise generation.

To avoid such noise generation, the solution disclosed in DE-OS 196 08 652 for an axial piston adjusting device proposes arranging in one of the two pressure chambers of the device, a slide which is mounted secure against rotation relative to a part of the housing connected to the drive pinion and which, with falling hydraulic medium pressure can be locked positively or by force with the element attached to the camshaft by the force of a compression spring.

A drawback of this solution which is suitable only for axial piston adjusting devices is, however, that the compression spring required for displacing the slide must have a relatively large diameter and, due to the restricted space in the device, cannot have more than a few turns. It is known from practice that such compression springs are relatively difficult and expensive to manufacture and thus, disadvantageously, increase the work and cost involved in the manufacture of the device. In the same way, the complicated procedure for the mounting of the slide inside the device and for the mounting of the parts cooperating therewith has proved to be relatively time-consuming and cost-intensive.

To avoid the mentioned noise generation in so-called vane-type adjusting devices, in contrast, DE-OS 196 23 818 discloses a solution which proposes arranging a locking pin in one of the vanes of the device, which pin is displaceable in a direction parallel to the central longitudinal axis of the device and, with falling hydraulic medium pressure, is pushed by the force of a compression spring into a locking opening in an end plate of an element attached to the crankshaft. This locking opening is in hydraulic communication with one of the pressure chambers so that the hydraulic medium pressure developing after the start of the internal combustion engine also acts on the end face of the locking pin and pushes the locking pin into its unlocking position in the vane.

A drawback of this solution which, in turn, is only suitable for vane-type adjusting devices, is that, for construction reasons, the end face of the locking pin which acts as a piston end surface is relatively small so that, for unlocking the locking pin, a relatively high hydraulic medium pressure has first to be built up. This has the result that, compared to axial piston adjusting devices, the unlocking of the locking pin is effected with some delay which can only be compensated by implementing expensive dimensioning measures on the rest of the hydraulic components.

OBJECTS OF THE INVENTION

It is an object of the invention to create a locking device for a device for varying the valve timing of gas exchange valves of an internal combustion engine in which the mentioned drawbacks are eliminated and which, by using simple means, is able to avoid noise emission occurring at the starting of the internal combustion engine, both in the case of axial piston as well as in vane-type adjusting devices.

This and other objects and advantages of the invention will become obvious from the following detailed description.

SUMMARY OF THE INVENTION

The invention achieves the above objects in a device of the initially described type by the fact that the element attached to the camshaft is arranged so as to penetrate axially through the element attached to the crankshaft and comprises on a free end outside of the device, a sealed locking element which is connected hydraulically to one or more of the pressure chambers of the device while being axially displaceable on an axial guide, and with which locking element, when the pressure of the hydraulic medium falls below a pressure required for displacing the adjusting element of the device, a non-rotatable force transmission connection between the element attached to the crankshaft and the element attached to the camshaft in one or more angular positions thereof relative to each other can be established independently of the adjusting element with the help of an auxiliary energy.

In a preferred embodiment of the invention, the locking element is configured as an axially displaceable locking piston which is displaceable away from the camshaft by hydraulic pressure and towards the camshaft by the auxiliary energy produced by one or more spring means so that, in the presence of hydraulic medium pressure, the locking piston is retained in a device-remote position, and in the absence of said pressure, the locking piston is pushed by the spring means towards the device.

It is further proposed to make the locking piston preferably as a concentric ring disposed on the free end of the element attached to the camshaft and comprising, at least partially or sectionwise, on its inner peripheral surface, an axial spur gearing which forms a part of its axial guide. The free end of the element attached to the camshaft then likewise comprises, on its outer peripheral surface, at least partially or sectionwise, a spur gearing which is complementary to the spur gearing of the locking piston and as a counterpart, forms a further constituent of the axial guide of the locking piston. By the at least partial or sectionwise configuration of the spur gearing on the element attached to the camshaft and on the locking piston is to be understood that it is possible to arrange the spur gearing uniformly over the periphery of these two components or only on some sections of the periphery thereof and/or to vary the length of the spur gearing relative to the width of the inner peripheral surface of the locking piston or the width of the outer peripheral surface of the free end of the element attached to the camshaft.

The most advantageous embodiment has proved to be one in which the spur gearing is made uniformly over the periphery of the components but in each case only on a part of the width of the inner peripheral surface of the locking piston and of the width of the outer peripheral surface of the free end of the element attached to the camshaft so that the locking piston slides with an untoothed part of its inner peripheral surface on an untoothed part of the outer peripheral surface of the free end and meshes with the toothed part of its inner peripheral surface with the toothed part of the outer peripheral surface of the free end. A number of radial bores extending towards the central longitudinal axis of the device are then preferentially arranged between the gearing of the element attached to the camshaft. Through these bores, the locking piston is supplied from a central bore in the element attached to the camshaft with the hydraulic medium required for its unlocking.

According to a further proposition of the invention, the locking piston comprises on its annular surface facing the camshaft, at least one concentrically arranged axial extension which locks positively into a complementary recess in the outer surface of a camshaft-remote housing part when the hydraulic medium pressure falls short of the pressure required for displacing the adjusting element of the device. Most advantageously, there are arranged two concentric axial extensions offset at 180° to each other on the annular surface of the locking piston facing the camshaft. These two axial extensions then snap into two recesses in the camshaft-remote housing part of the device which are likewise offset at 180° to each other. Both the extensions and the recesses may have any geometric shape although, from the manufacturing point of view, round or even square shapes are the easiest to make. It is, however, also possible to arrange more than two axial extensions on the annular surface of the locking piston facing the camshaft to cooperate with the same number of recesses which are similarly spaced on the camshaft-remote housing part. Thus, the axial extensions on the locking piston and the recesses on the camshaft-remote housing part of the device establish the positive connection between the element attached to the crankshaft and the element attached to the camshaft and are preferably arranged so that this connection is possible in that end position of the adjusting element which corresponds to the preferred start position.

If more recesses are arranged in the camshaft-remote housing part than axial extensions on the locking piston, it is also possible to block the adjusting element of the device in a position situated between the end positions, provided the start behavior of the internal combustion engine permits this. In the same way, it is also possible, in an equivalent embodiment of the invention, to arrange suitable recesses on the locking piston in place of the axial extensions and conversely configure the camshaft-remote housing part of the device with corresponding axial extensions in place of recesses. The camshaft-remote housing part is made preferably as a separate end housing plate screwed on to the rest of the housing of the device and comprising, on its outer radial edge, axially parallel screw-holes made as slots to permit an adjustment between the element attached to the camshaft, the locking piston and the element attached to the crankshaft in order to achieve an exact locking in the preferred start position.

In another advantageous embodiment of the invention, it is proposed to arrange each complementary recess in the outer surface of the camshaft-remote housing part, preferably within a ring segment-shaped guide groove provided in the outer surface of the camshaft-remote housing part and to arrange an axial extension of the locking piston for displacement within this guide groove whose radial limiting edges at the same time form end stops for the adjusting element of the device. Thus, in the unlocked position of the locking piston and during a relative rotation between the element attached to the camshaft and the element attached to the crankshaft, the axial extensions of the locking piston slide on the bottom surface of the groove and abut in each end position of adjustment against the limiting edges of the guide groove. Upon abutment of the axial extensions against the limiting edge of the guide groove which corresponds to the preferred start position of the internal combustion engine, a snapping of the axial extensions into the complementary recesses within the guide grooves takes place simultaneously with a fall of hydraulic medium pressure.

Due to the limiting edges of the guide groove which act as end stops, the otherwise usual support of the adjusting element against plastic end stops within the device is replaced in the invention by a support of the element attached to the camshaft against the element attached to the crankshaft, which support is effected by the locking piston and contributes further to a reduction of noise emission in such devices. However, such a configuration is not absolutely necessary for the functioning of the locking device of the invention and is also only suitable if the element attached to the camshaft has to be fixed relative to the element attached to the crankshaft only in one position and not in a number of different positions as described above. Regarding the initially mentioned radial bores between the spur gearing on the element attached to the camshaft for the supply of the locking piston with the hydraulic pressure medium required for its locking, it has proved to be advantageous, in a configuration having the aforesaid guide grooves, to provide a different type of supply of pressure medium to the locking piston, namely, directly through pressure medium channels leading through the complementary recesses in the camshaft-remote using part to the pressure chambers of the device because, in this way, on starting of the internal combustion engine, the pressure chambers of the device are at first filled with pressure medium before this can act on the locking piston. This results in an advantageous lapse of time between the filling of the pressure chambers and the unlocking of the device to the effect that the quantity and pressure of the hydraulic medium required for a hydraulic support of the adjusting element of the device are available immediately upon unlocking of the device.

In a further development of the invention, a concentric cylindrical web pointing axially away from the device is formed on the outer surface of the camshaft-remote housing part to define, together with the portion of the camshaft-remote housing part comprising the recesses, and with the locking piston, a hydraulic pressure chamber separate from the pressure chambers of the device and situated outside of the device properly speaking. The locking piston is connected substantially leak-tight by sealing means outwardly to the inner peripheral surface of the cylindrical web and inwardly to the outer peripheral surface of the free end of the element attached to the camshaft. The sealing of the locking piston relative to the inner peripheral surface of the cylindrical web of the camshaft-remote housing part is advantageously effected by a piston sealing ring inserted into the outer peripheral surface of the locking piston, while the sealing of the locking piston relative to the outer peripheral surface of the free end of the element attached to the camshaft is effected by a piston sealing ring inserted into this peripheral surface. In this case, too, it is equally possible, if desired, to replace the piston sealing rings with elastomer sealing rings or other suitable sealing rings, and to make the ring grooves for the reception of the sealing means in the respective other component in each case.

To enlarge the effective piston end surface of the locking piston, it is further possible to place the concentric cylindrical web on the outer surface of the camshaft-remote housing part by a circumferential extension of the peripheral surface of the camshaft-remote housing part so that the diameter of the locking piston can be made considerably larger. The screw-holes for the fixing of the camshaft-remote housing part on the rest of the housing of the device as well as their threaded counterparts are then arranged within radial fixing webs additionally formed on the peripheral surface of the camshaft-remote housing part and on the peripheral surface of the rest of the housing.

Finally, according to another proposition of the invention, a counter pressure ring is fixed in a camshaft-remote position, behind the locking piston on the free end of the element attached to the camshaft to concentrically surround this element, with which counter pressure ring, a pre-tension for the spring means which produces the auxiliary energy required for displacing the locking piston towards the device can be created. Preferably, this counter pressure ring is fixed by a snap ring engaging into a groove in the outer peripheral surface of the free end of the element attached to the camshaft, so that the locking piston remains axially movable towards the device on the free end of the element attached to the camshaft, but its device-remote end position is fixed by the snap ring in to prevent its axial extensions from slipping out of the guide grooves in the camshaft-remote housing part. However, it is also conceivable to screw the counter pressure ring on the camshaft-remote end face of the element attached to the camshaft or to use any other type of securing.

The spring means for producing the auxiliary energy of the locking piston is constituted preferably by a number of compression or ondular springs arranged coaxially around the element attached to the camshaft and guided on axial pins fixed correspondingly on the camshaft-remote annular surface of the locking piston, while being supported at one end on the camshaft-remote annular surface of the locking piston and, at the other end, on the same number of radial web segments on the counter pressure ring which is fixed on the element attached to the camshaft. It has proved to be particularly advantageous to dimension the compression or ondular springs so that a hydraulic medium pressure of a maximum of 0.5 bars applied to the locking pin undoes the locking between the element attached to the camshaft and the element attached to the crankshaft.

As a rule, three coiled compression springs of appropriate dimension and spaced at an angular distance of 120° to one another around the element attached to the camshaft and guided on axial pins fixed similarly on the locking piston have proved to be sufficient. Alternatively, however, it is also possible to configure the spring means for producing the auxiliary energy for the locking pin as a single compression or ondular spring surrounding the free end of the element attached to the camshaft and supported at one end on the camshaft-remote annular surface of the locking piston and at the other end, on a circumferential radial web on the counter pressure ring, although this is accompanied by the initially mentioned problem of the relatively large diameter of the compression spring and its small number of turns.

Thus, the locking device of the invention for a device for varying the valve timing of gas exchange valves of an internal combustion engine possesses the advantage over locking devices known from the prior art in that it creates a start locking which is suitable both for axial piston adjusting devices and for vane-type adjusting devices and which effectively prevents noise emission at the starting of the internal combustion engine. The auxiliary energy required for this type of locking is advantageously produced by a plurality of spring means arranged coaxially around the element attached to the camshaft so that, already due to the possibility of using standard compression springs, the time and cost of manufacturing devices equipped with this type of locking can be reduced.

A further reduction of the cost of devices configured according to the invention is achieved by the fact that all the individual components required for locking have a simple structure and are arranged, so to speak, outside of the device so that they can be manufactured and mounted economically using suitable procedures. A further advantage is that, in all cases of use, the piston surface of the locking piston is relatively large and this enables unlocking with low pressures and without noteworthy delays.

The invention will now be described with reference to one example of embodiment which is illustrated in the drawings.

DETAILED DESCRIPTION OF THE DRAWINGS

Figure 1:
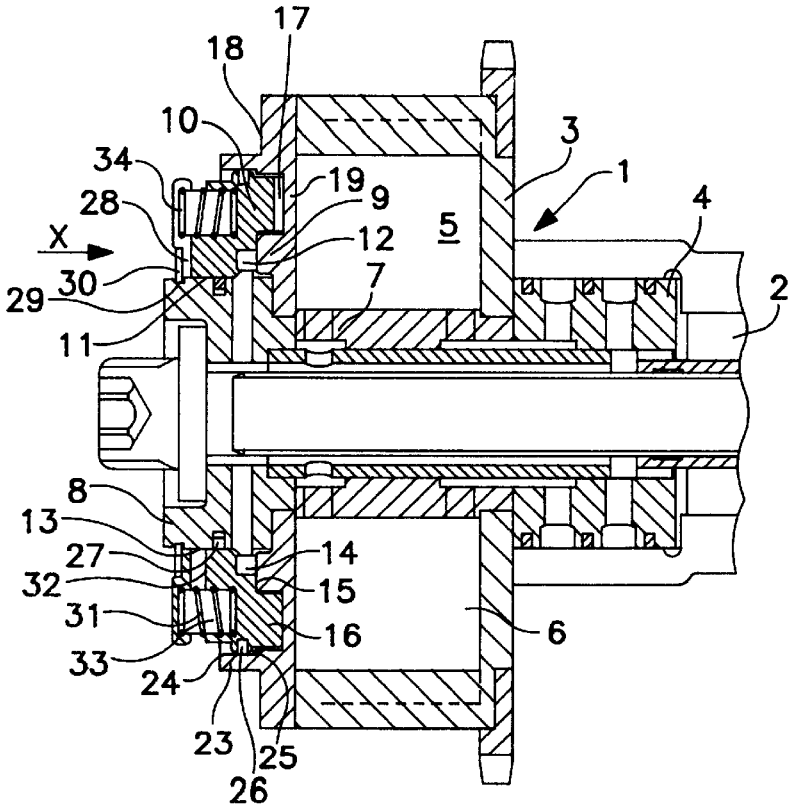
FIG. 1 shows a cross-section through a vane-type adjusting device having a locking device of the invention.

FIG. 1 shows a device 1 for varying the valve timing of gas exchange valves of an internal combustion engine, which device 1 is arranged in the region of the cylinder head of the internal combustion engine on a camshaft 2 and, in the present case, is a vane-type adjusting device. This device 1 comprises an element 3 attached to the crankshaft, not shown, of the internal combustion engine and in driving relationship with the crankshaft through a traction means. The device 1 further comprises an element 4 attached rotationally fast to the camshaft 2. Between these elements 3, 4, there are arranged at least two pressure chambers 5, 6 which are connected to a pressure medium supply, and a hydraulically actuatable adjusting element 7.

In the illustrated device 1, the pressure chambers 5, 6 are formed inside the device between limiting walls, not shown for the sake of simplicity, and the adjusting element 7 is constituted by an inner rotor, not shown, generally having a plurality of vanes, each of which is arranged between two limiting walls. A connection for the transmission of force from the element 3 attached to the crankshaft to the element 4 attached to the camshaft is established in a known manner by this adjusting element 7 configured as an inner rotor. The two elements 3, 4 are rotatable or fixable relative to each other within an adjusting range defined by the limiting walls and thus effect a relative rotation and/or a continuous hydraulic clamping of the camshaft 2 relative to the crankshaft.

To avoid noise emission occurring at the starting of the internal combustion engine which can be caused by an inadequate hydraulic support of the adjusting element 7 of the device 1, the element 4 attached to the camshaft is configured so as to penetrate axially through the element 3 attached to the crankshaft and, as can be seen in FIG. 1, comprises on a free end 8 outside of the device 1, a sealed locking element which is axially displaceable on an axial guide 9 and connected hydraulically to the pressure chambers 5, 6 of the device 1. When the pressure of the hydraulic medium falls below the pressure required for displacing the adjusting element 7 of the device 1, a non-rotatable force transmission connection between the element 3 attached to the crankshaft and the element 4 attached to the camshaft can be established by this locking piston with the help of an auxiliary energy and independently of the adjusting element 7.

In the present embodiment, the locking element is configured as an axially displaceable locking piston 10 which is displaceable away from the camshaft by hydraulic pressure and towards the camshaft by the auxiliary energy produced by a plurality of spring means. The piston 10 is configured as a concentric ring which is disposed on the free end 8 of the element 4 attached to the camshaft and comprises, on a portion of its inner peripheral surface, an axially extending circumferential spur gearing 12 which forms a part of its axial guide 9.

Figure 2:
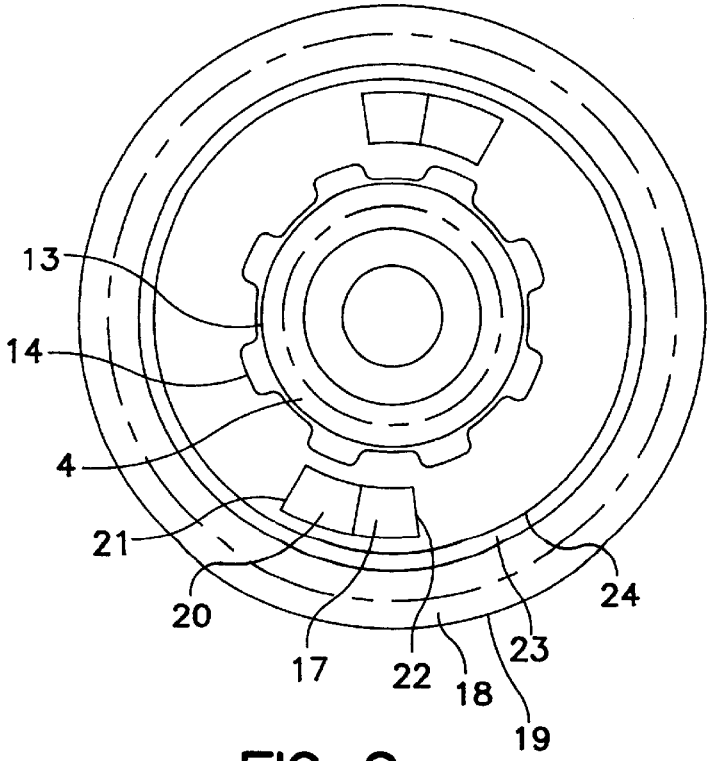
FIG. 2 is the view X of FIG. 1 with the locking piston of the locking device of the invention removed.

The other part of this axial guide 9 is formed, as can be clearly seen in FIG. 2, by a circumferential spur gearing 14 which is complementary to the spur gearing 12 of the locking piston 10 and likewise extends only on a portion of the outer peripheral surface 13 of the free end 8 of the element 4 attached to the camshaft. Thus, the locking piston 10 slides by a non-toothed portion of its inner peripheral surface 11 on a non-toothed portion of the outer peripheral surface 13 of the free end 8 and at the same time, its spur gearing 12 meshes with the spur gearing 14 of the free end 8.

It can be seen further in FIG. 1 that, on its annular surface 15 facing the camshaft, the locking piston 10 comprises two axial extensions 16 which are offset at 180° to each other. When the pressure medium pressure falls below the pressure required for displacing the adjusting element 7 of the device 1, the axial extensions 16 lock positively into two complementary recesses 17 arranged likewise offset to each other at 180° in the opposing outer surface 18 of a camshaft-remote housing part 19 which is configured as an end plate of the device 1. These complementary recesses 17, which can be seen more clearly in FIG. 2, are further arranged each in a respective ring segment-shaped guide groove 20 in the outer surface 18 of the camshaft-remote housing part 19.

In the unlocked position of the locking piston 10, its axial extensions 16 having, for example, a square shape, are displaceable within these guide grooves 20. The radial limiting edges of the guide grooves 20 at the same time form end stops 21, 22 for the adjusting element 7 of the device 1 which is rigidly connected to the locking piston 10, so that, in each end position of adjustment, the element 3 attached to the crankshaft is supported through the locking piston 10 on the element 4 attached to the camshaft. Both figures further show that a concentric cylindrical web 23 pointing axially away from the device 1 is formed on the outer surface 18 of the camshaft-remote housing part 19 and defines a hydraulic pressure chamber for the locking piston 10 outside of the device 1. The locking piston 10 is connected leak-tight by sealing means radially inwardly to the inner peripheral surface 24 of the cylindrical web 23 and radially outwardly to the outer peripheral surface 13 of the free end 8 of the element 4 attached to the camshaft. In the present embodiment, the sealing of the locking piston 10 relative to the inner peripheral surface 24 of the cylindrical web 23 is achieved by a piston sealing ring 26 inserted into the outer peripheral surface 25 of the locking piston 10, and relative to the outer peripheral surface 13 of the free end 8 of the element 4 attached to the camshaft, by a piston sealing ring 27 inserted into this outer peripheral surface 13.

Finally, to produce a pre-tension for the spring means producing the auxiliary energy for the locking piston 10, a counter pressure ring 28 is arranged, as shown in FIG. 1, in a camshaft-remote position, behind the locking piston 10, on the free end 8 of the element 4 attached to the camshaft to surround this element. This counter pressure ring 28 is fixed by a snap ring 30 engaging into a groove 29 in the outer peripheral surface 13 of the element 4 attached to the camshaft so that, to prevent the axial extensions 16 from slipping out of their guide grooves 20 in the camshaft-remote housing part 19 when pressure is applied, the locking piston 10 comes to abut against this counter pressure ring 28.

The spring means for producing the auxiliary energy of the locking piston 10 is constituted by three compression springs 31 which are arranged at an angular distance of 120° from one another coaxially around the element 4 attached to the camshaft and are guided on axial pins 33 fixed correspondingly on the camshaft-remote annular surface 32 of the locking piston 10, while being supported at one end on the camshaft-remote annular surface 32 of the locking piston 10, and, at the other end, on the same number of radial web segments 34 on the counter pressure ring 28.

Various modifications of the locking device of the invention may be made without departing from the spirit or scope thereof and it is to be understood that the invention is intended to be limited only as defined in the appended claims.

What is claimed is:

1. A device for varying valve timing of gas exchange valves of an internal combustion engine, said device being arranged in a region of a cylinder head of the internal combustion engine on an inlet or an outlet camshaft and comprising an element which is attached to a crankshaft of the internal combustion engine and is in driving relationship with the crankshaft through a traction element, said device further comprising an element fixedly attached to the camshaft, there being arranged between the two said elements, at least two pressure chambers connected to a pressure medium supply and a hydraulically actuatable adjusting element through which a connection for transmitting force from the element attached to the crankshaft to the element attached to the camshaft is established, and through which the two said elements can be made to rotate or be fixed relative to each other within an adjusting range and thus effect at least one of a relative rotation and a continuous hydraulic clamping of the camshaft relative to the crankshaft, characterized in that the element attached to the camshaft is arranged so as to penetrate axially through the element attached to the crankshaft and comprises a free end outside of the device, on which free end is arranged a sealed locking element which is connected hydraulically to one or more of the pressure chambers of the device while being axially displaceable on an axial guide, and with which locking element, when the pressure of the hydraulic medium falls below a pressure required for displacing the adjusting element of the device, a non-rotatable force transmission connection between the element attached to the crankshaft ad the element attached to the camshaft in one or more angular positions thereof relative to each other can be established independently of the adjusting element with the help of an auxiliary energy.

2. The device of claim 1 wherein the locking element is configured as an axially displaceable locking piston which is displaceable away from the camshaft by hydraulic pressure and towards the camshaft by the auxiliary energy produced by at least one or more spring mean.

3. The device of claim 2 wherein the locking piston is configured as a concentric ring disposed on the free end of the element attached to the camshaft and comprising, at least partially or sectionwise, on an inner peripheral surface, an axial spur gearing which forms a part of an axial guide of the locking piston.

4. The device of claim 3 wherein the free end of the element attached to the camshaft comprises, on an outer peripheral surface, at least partially or sectionwise, a spur gearing which is complementary to the spur gearing of the locking piston and forms a further constituent of the axial guide of the locking piston (10).

5. The device of claim 2 wherein the locking piston comprises on an annular surface thereof facing the camshaft, at least one concentrically arranged axial extension which locks positively into a complementary recess in an opposing outer surface of a camshaft-remote housing part when the hydraulic medium pressure falls short of the pressure required for displacing the adjusting element of the device.

6. The device of claim 5 wherein each complementary recess in the outer surface of the camshaft-remote housing part is arranged within a ring segment-shaped guide groove provided in the outer surface of the camshaft-remote housing part, and the axial extension of the locking piston is arranged for displacement within this guide groove whose radial limiting edges at the same time form end stops for the adjusting element of the device.

7. The device of claim 2 wherein a concentric cylindrical web pointing axially away from the device is formed on the outer surface of the camshaft-remote housing part, and the locking piston is connected substantially leak-tight by sealing means inwardly to an inner peripheral surface of the cylindrical web and outwardly to the outer peripheral surface of the free end of the element (4) attached to the camshaft.

8. The device of claim 7 wherein the locking piston is sealed relative to the inner peripheral surface of the cylindrical web of the camshaft-remote housing part by a piston sealing ring inserted into an outer peripheral surface of the locking piston, and relative to the outer peripheral surface of the free end of the element attached to the camshaft by a piston sealing ring inserted into the outer peripheral surface of the free end.

9. The device of claim 2 wherein a counter pressure ring is arranged concentrically around the element attached to the camshaft and produces a pre-tension for the spring means which produces the auxiliary energy required for displacing the locking piston towards the device, and said counter pressure ring is fixed by a snap ring inserted into a groove in the outer peripheral surface of the element attached to the camshaft in a camshaft-remote position, behind the locking piston on the free end of the element attached to the camshaft.

10. The device of claim 2 wherein the spring means for producing the auxiliary energy of the locking piston is constituted by a plurality of compression springs which are arranged coaxially around the element attached to the camshaft and guided on axial pins fixed correspondingly on a camshaft-remote annular surface of the locking piston, said springs being supported at one end on the camshaft-remote annular surface of the locking piston and, at another end, on a same number of radial web segments on the counter pressure ring which is fixed on the element attached to the camshaft.

11. The device of claim 9 wherein the spring means for producing the auxiliary energy of the locking piston is constituted by a plurality of compression or ondular springs which are arranged coaxially around the element attached to the camshaft and guided on axial pins fixed correspondingly on a camshaft-remote annular surface of the locking piston, said springs being supported at one end on the camshaft-remote annular surface of the locking piston and, at another end, on a same number of radial web segments on the counter pressure ring which is fixed on the element attached to the camshaft.

* * * * *